US006373202B1

(12) United States Patent
Ito et al.

(10) Patent No.: US 6,373,202 B1
(45) Date of Patent: Apr. 16, 2002

(54) COLOR CATHODE RAY TUBE

(75) Inventors: Yoshinori Ito; Takeshi Kaneki, both of Mobara; Mitsuru Watanabe, Mutsuzawa; Souichi Sakurai, Yokohama, all of (JP)

(73) Assignee: Hitachi Ltd., Tokyo (JP)

( * ) Notice: Subject to any disclaimer, the term of this patent is extended or adjusted under 35 U.S.C. 154(b) by 0 days.

(21) Appl. No.: 09/702,774

(22) Filed: Oct. 31, 2000

(30) Foreign Application Priority Data

Oct. 4, 2000 (JP) ..... 2000-309295

(51) Int. Cl.[7] ..... G09G 1/04

(52) U.S. Cl. ..... 315/370; 315/368.11; 315/366; 313/440; 313/442; 335/210; 335/212

(58) Field of Search ..... 315/366, 368.11, 315/368.25, 370, 382, 399; 313/412, 413, 421, 437, 442, 440; 335/210, 212, 213, 284, 302

(56) References Cited

U.S. PATENT DOCUMENTS 3,748,526 A * 7/1973 Wedam ..... 315/13 CG
4,159,456 A * 6/1979 Smith ..... 335/210
5,900,693 A * 5/1999 Azzi et al. ..... 313/440

* cited by examiner

*Primary Examiner*—Haissa Philogene
(74) *Attorney, Agent, or Firm*—Milbank, Tweed, Hadley & McCloy LLP

(57) ABSTRACT

In a color cathode ray tube having a flat panel exterior surface, the screen distortion and the convergence give rise to problems. To overcome these problems, by arranging bar magnets in such a manner that they are disposed parallel to a screen and are shifted from upper and lower ends of a horizontal deflection coil of a deflection yoke by not less than 10 mm in the direction perpendicular to a tube axis, the distortion of the screen and the characteristics of the convergence can be simultaneously improved.

13 Claims, 14 Drawing Sheets

COLOR CATHODE RAY TUBE

BACKGROUND OF THE INVENTION

1. Field of the Invention

The present invention relates to a color cathode ray tube, and more particularly to a color cathode ray tube capable of correcting convergence and distortion.

2. Description of the Related Art

With respect to a color cathode ray tube, in general, to make an exterior surface of a panel flat, the visibility of a screen can be improved. However, the flattening of the exterior surface of the panel increases a so-called raster distortion on the screen. Here, the raster distortion is a phenomenon in which the screen cannot hold a rectangular shape and pin distortions appear at upper and lower portions of the screen. In case of a color cathode ray tube having a round exterior panel surface, this raster strain can be made approximately zero. The raster distortion on the screen can be adjusted to some extent by adjusting the wiring distribution of a deflection coil and the magnetization intensity of magnets which are used auxiliary components. Here, the magnets used as the auxiliary components are disposed at positions not away from the horizontal coil wiring adjacent to upper and lower ends of a horizontal deflection coil of the deflection yoke. This is because the deflection yoke is required to be as small as possible to reduce the cost and power consumption. However, with respect to the cathode ray tube having an approximately flat exterior panel surface, there arises a phenomenon that the pin distortion of the screen (hereinafter called "raster distortion") cannot be corrected so long as the similar method is used. Accordingly, when it intends to eliminate the raster distortion by the conventional method, it gives rise to a problem that the misconvergence is generated. Here, the convergence means that electron beams which make red, blue and green phosphor elements illuminate are focused on one point on a phosphor screen.

SUMMARY OF THE INVENTION

Accordingly, it is an object of the present invention to provide a color cathode ray tube having a flat panel which can cope with the convergence and the raster distortion simultaneously. To achieve this object, irrespective of the shape of a deflection yoke, bar magnets or rod magnets for correcting the raster distortion and the convergence are mounted on the deflection yoke at positions away from an upper end or a lower end of a horizontal deflection coil of the deflection yoke in the direction perpendicular to a tube axis by a distance of not less than 10 mm. Further, not only the magnetization intensity of the magnet but also the magnet length are set to values not less than predetermined values.

DETAILED DESCRIPTION OF THE PREFERRED EMBODIMENTS

Figure 1:
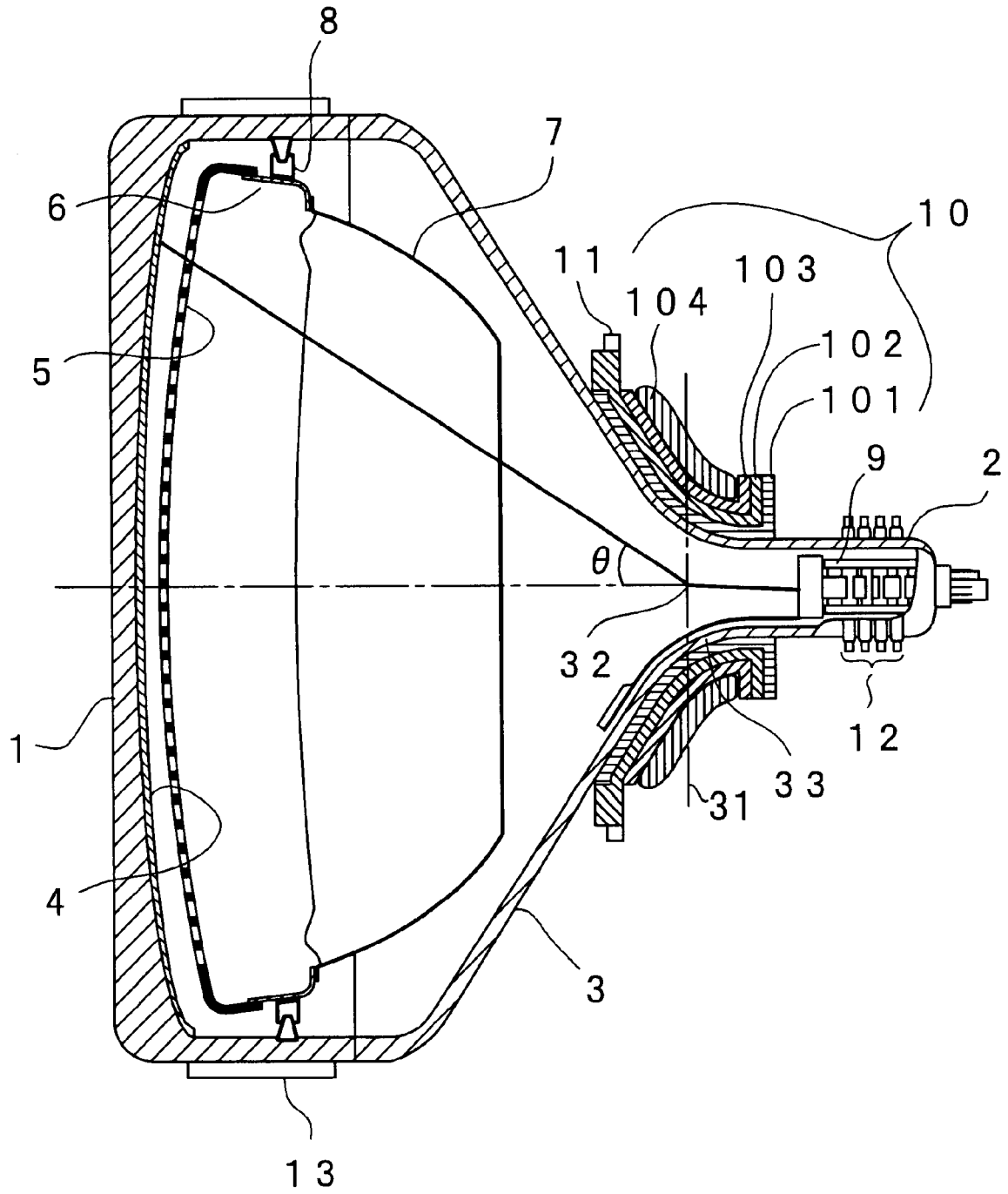
FIG. 1 is a cross-sectional view of a color cathode ray tube according to one embodiment of the present invention.

The present invention is explained in detail hereinafter in conjunction with attached drawings. FIG. 1 is a schematic view of a color display tube whose panel 1 has a flat exterior surface. The panel 1 has the flat exterior surface and a curved interior surface. The reason why the interior surface of the panel has a curvature is to make a shadow mask 5 which faces the interior surface of the panel have a curvature. A neck 2 stores an electron gun having an in-line array and is connected to the panel 1 by way of a funnel 3. A crossing point 32 between a reference line 31 and a tubular axis is defined as the center of deflection. An angle θ made by a line which connects a point of the interior surface of the panel on which the electron beam impinges and the center 32 of deflection and the tubular axis is defined as the deflection angle. This reference line 31 becomes a basis of designing color picture tube and is set at a panel-side than a seal portion between the neck 2 and the funnel 3. Here, a maximum deflection angle means a doubled value of an angle made by a line which connects a diagonal axis end portion of an effective screen on the interior of the panel and the center 32 of deflection and the tube axis. The maximum deflection angle in this embodiment is approximately 100 degrees. Dot-type phosphors are formed on a phosphor screen 4. The shadow mask 5 has a large number of round apertures, is supported on a support frame 6, and is mounted on the panel 1 by means of springs 8. The shadow mask 5 includes an apertured portion where a large number of apertures which allow the electron beams to pass therethrough are formed. An inner magnetic shield 7 is attached to the support frame 6. A deflection yoke 10 which deflects the electron beams is mounted on a cone portion 33 of the funnel 3. A main portion of the deflection yoke 10 is comprised of a horizontal deflection coil 101, a separator 102, a vertical deflection coil 103 and a core 104. Bar magnets or rod magnets 11 which are provided for adjusting the raster distortion and the convergence are arranged above and below the horizontal deflection coil 101. By a magnet assembly 12, the convergence and the purity of the electron beams are achieved. The implosion of the bulb can be prevented by a tension band 13.

As a method for evaluating the flatness of the exterior surface of the panel, there has been a method which evaluates the flatness by how many times the equivalent radius of curvature in the diagonal direction is made larger compared to Ro=42.5 V+45 provided that the effective diagonal diameter of the panel is set as V. The larger this value Ro, the flatness of the exterior surface is increased. When the cathode ray tube has the effective diameter of 20 inches, a case that the equivalent radius of curvature in the diagonal direction is made Ro=42.5 V+45=895 mm is called 1R. A case that the equivalent radius of curvature in the diagonal direction is made 895 mm×2=1790 mm is called 2R. When the equivalent radius of curvature in the diagonal direction becomes not less than 10,000 mm, the exterior surface of the panel appears substantially completely flat. With respect to the panel having the effective diameter of 20 inches used in the evaluation, the equivalent radius of curvature in the diagonal direction of the exterior surface of the panel is 62,500 mm. The equivalent radius of curvature Re is defined as follows.

$$Re=(D^2+Z^2)/2Z$$

Figure 2:
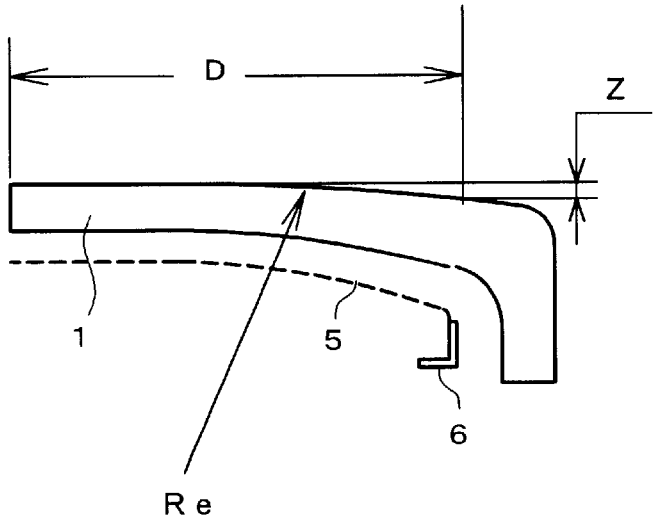
FIG. 2 is a cross-sectional view of a panel of the color cathode ray tube of the embodiment.

Here, D is the half of the effective diagonal diameter and Z is the difference in height between the center of the panel and the diagonal ends of the effective surface. Such a state is shown in FIG. 2.

Figure 3:
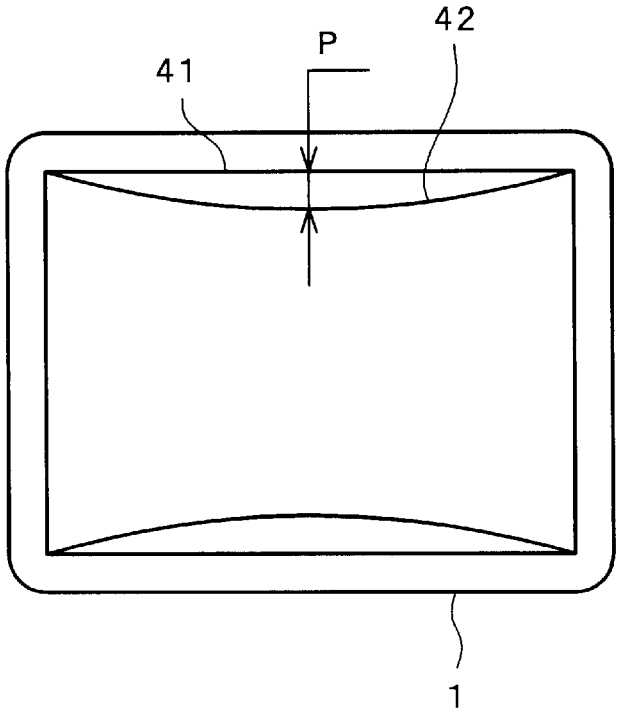
FIG. 3 is an example of the raster distortion.

When the panel becomes flat, problems on the raster distortion and the convergence become apparent. For example, when the exterior surface of this embodiment forms images on a screen using a deflection yoke system which exhibits the proper image distortion and the proper convergence with the flatness of the 2R panel, pin distortions of approximately 1 mm are generated. FIG. 3 shows the state of this raster distortion. In FIG. 3, numeral 41 indicates a normal rectangular raster and numeral 42 indicates a raster when the pin distortion exists. The raster distortion is expressed by a distortion amount P along a short axis of the screen in FIG. 3. Along with the correction of this pin distortion P, the convergence is changed. This raster distortion and the convergence are generally corrected by the winding distribution of the deflection yoke 10 and the magnetization intensity of the bar correction magnets 11. Here, since the dimension of the deflection yoke 10 has a large influence on the cost of deflection yoke, it is considered important to suppress the dimension of the deflection yoke as small as possible. Accordingly, to satisfy the demand to reduce the dimension of the deflection yoke, the bar magnets used for the correction of the raster distortion and the convergence are mounted in the vicinity of the distal end of the horizontal deflection coil. However, it is difficult for such a conventional constitution to simultaneously satisfy the improvement of the raster distortion and the improvement of the convergence characteristics.

Figure 4:
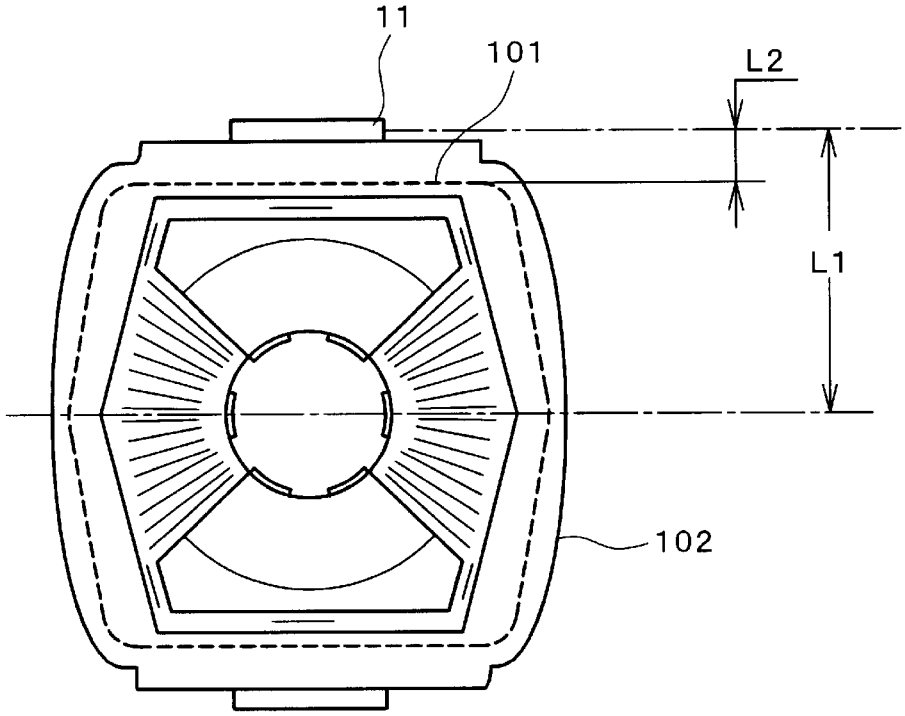
FIG. 4 is a front view of a round-type deflection yoke of the color cathode ray tube of the embodiment.
Figure 5:
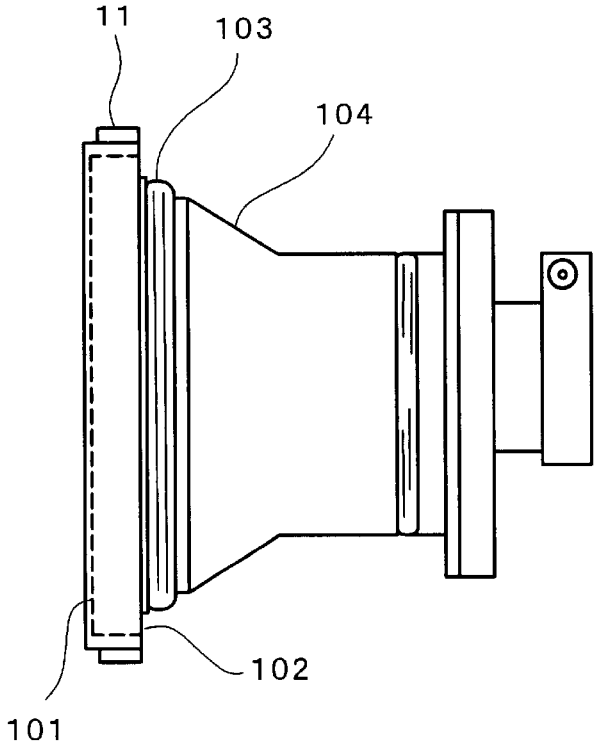
FIG. 5 is a side view of a round-type deflection yoke of the color cathode ray tube of the embodiment.
Figure 6:
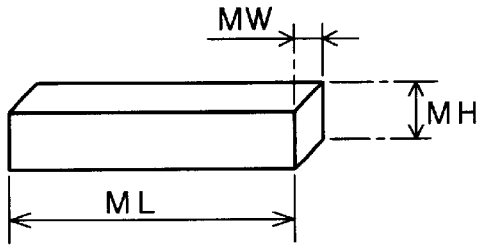
FIG. 6 is a schematic view of a bar magnet of the color cathode ray tube of the embodiment.

Without sticking to such a constitution of the prior art, the present invention aims at the simultaneous improvement of both of the raster distortion and the convergence characteristics by shifting the position of the bar magnets away from the horizontal deflection coil by a considerable amount. A technique to correct the raster distortion while maintaining a fixed convergence level can be commonly applied to various deflection yoke systems. Following examples relate to the evaluations on a cathode ray tube in which the diagonal diameter is 17 inches, the funnel portion 3 has a round cone portion 33 and the maximum deflection angle is 100 degrees and a deflection yoke used in such a cathode ray tube. FIG. 4 is a front view of this deflection yoke. Since the deflection yoke has the large deflection angle of 100 degrees, the deflection yoke becomes larger in dimension than widely-spread deflection yokes having the deflection angle of 90 degrees. A horizontal deflection coil 101 is held by a separator 102. In FIG. 4, the distance between the center of the bar magnet 11 and the center of the deflection yoke is set as L1 and the distance between an upper end of the horizontal deflection coil 101 and the center of the bar magnet 11 is set as L2. The distance between the center of the deflection yoke and the upper end of the horizontal deflection coil 101 is set to 58 mm. FIG. 5 is a schematic side view of the same deflection yoke. In FIG. 5, numeral 103 indicates a vertical deflection coil and numeral 104 indicates a core. In the inside of the separator 102, the horizontal deflection coil 101 is held. The bar magnets 11 are mounted above and below flange portions of the separator 102. In this embodiment, the bar magnets 11 are mounted such that they are aligned with rear end portions of the flange portions of the separators 102. FIG. 6 shows the contour of the bar magnet 11. In this embodiment, the cross-sectional area MW×MH of the bar magnet 11 is set to 4.5 mm×5.0 mm. As shown in FIG. 4, the separator portion is vertically extended largely so as to position the bar magnet the sufficient distance L1 spaced apart from the center of the deflection yoke to the bar magnet 11. Accordingly, the deflection yoke of the present invention becomes further larger than the conventional deflection yokes.

Figure 7:
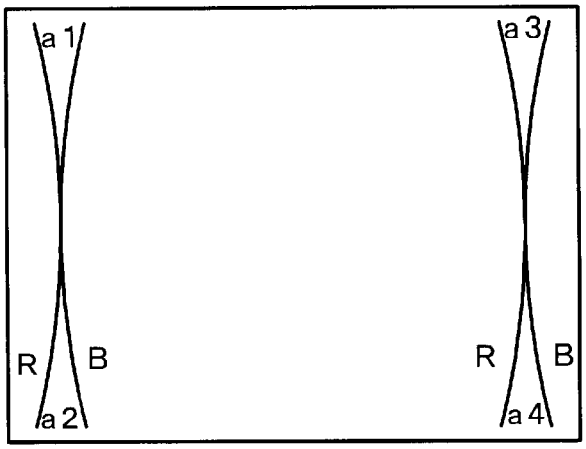
FIG. 7 is a convergence pattern showing the bow-shaped or arcuate misconvergence at sides of a display screen.
Figure 8:
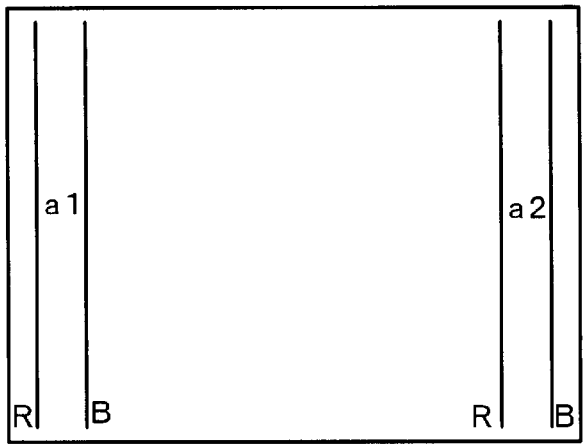
FIG. 8 is a convergence pattern showing the longitudinal line misconvergence at sides of a display screen.
Figure 9:
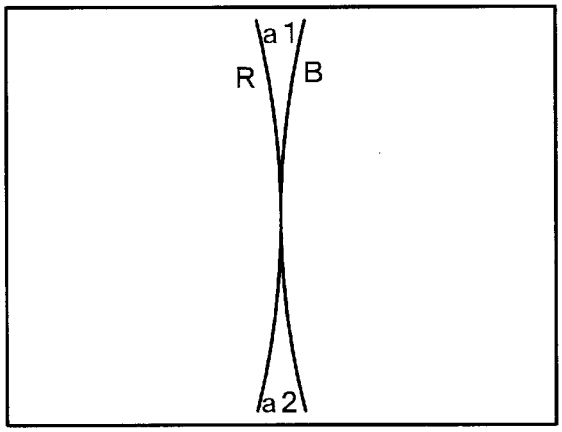
FIG. 9 is a convergence pattern showing the bow-shaped misconvergence at the center of a display screen.
Figure 10:
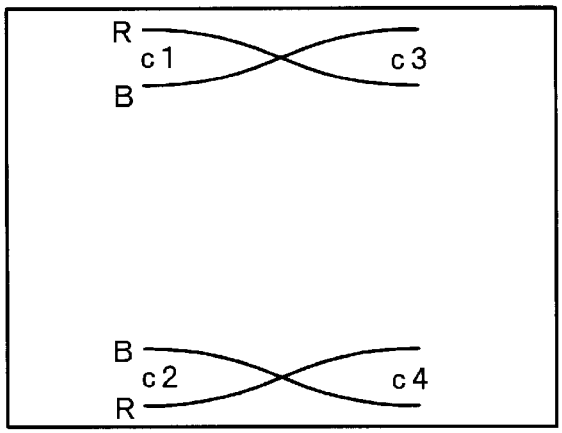
FIG. 10 is a convergence pattern showing the vertical-direction misconvergence of transverse lines at upper and lower portions of a display screen.
Figure 11:
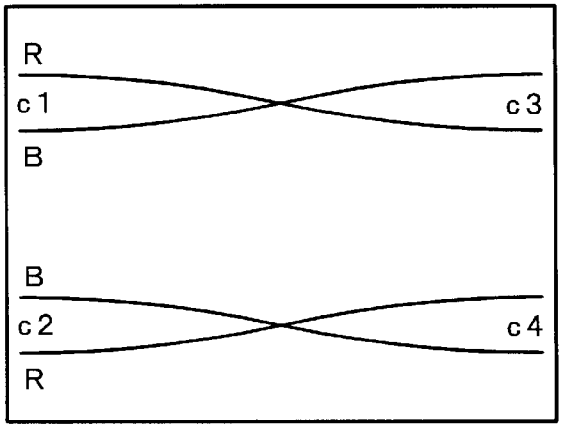
FIG. 11 is a convergence pattern showing the vertical-direction misconvergence of transverse lines at the intermediate position of a display screen.

There are various types of misconvergence. The inventors of the present invention have focused their attention to a point that the misconvergence shown in FIG. 7 to FIG. 11 are important in view of the relationship between the misconvergence and the pin distortion P. FIG. 7 to FIG. 9 define the misconvergence in the horizontal direction. FIG. 7 shows the bow-shaped or arcuate misconvergence at both sides of the screen. R indicates red lines and B indicates blue lines. a1 to a4 indicate amounts of respective misconvergence. When the positional relationship between the red and blue lines in the drawing are reversed, they take negative values. The quantitative evaluation of the misconvergence is expressed by PQH=(a1+a2+a3+a4)/4. FIG. 8 shows the misconvergence made of red and blue lines in parallel at sides of the screen. In this case, when the positional relationship between the red and blue lines in the drawing are reversed, they also take negative values. The quantitative evaluation of the misconvergence is expressed by XH=(a1+a2)/2. FIG. 9 shows the bow-shaped misconvergence at the center of the screen and the quantitative evaluation is expressed by YH=(a1+a2)/2. When the positional relationship between the red and blue lines in the drawing are reversed, they take negative values. a1 to a4 in FIG. 7 and FIG. 9 are measured at upper and lower end portions of the screen. As an amount of the misconvergence in the horizontal direction which sums up the misconvergence in FIG. 7 to FIG. 9, FT=PQH−XH−YH is used. FIG. 10 and FIG. 11 show the evaluation of the misconvergence in the vertical direction. FIG. 10 shows the misconvergence at upper and lower portions of the screen as well as the intermediate portion between both sides of the screen and the center of the screen. The quantitative evaluation of the misconvergence is expressed by S1=(c1+c2+c3+c4)/4. In this case, when the positional relationship between the red and blue lines in the drawing are reversed, they also use negative values. FIG. 11 shows the misconvergence in the intermediate portion between the center portion and upper and lower portions at both sides of the screen. As the quantitative evaluation, S3=(c1+c2+c3+c4)/4 is used. As the evaluation of the misconvergence in the vertical direction, SS=S1−S2 is used. With respect to the relationship between the misconvergence and the pin distortion P, it is preferable that the absolute amounts of FT and SS are small.

Figure 12:
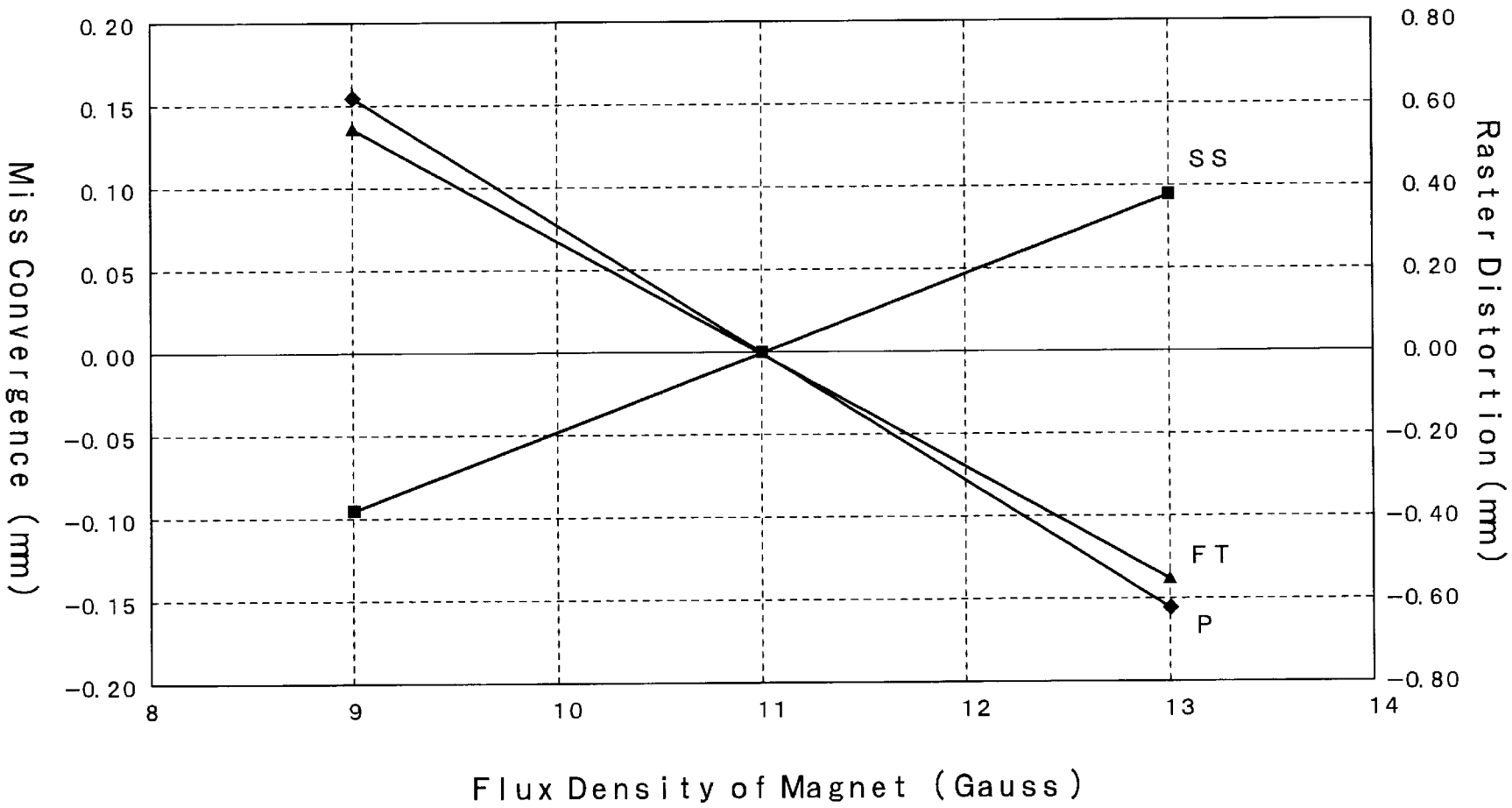
FIG. 12 is a diagram showing the change of the convergence and the raster distortion when the magnetization intensity of bar magnets is changed.

FIG. 12 is a diagram showing the changes of the misconvergence and the raster distortion when the magnetization intensity of the magnet (flex density of magnet)is changed under the condition that the magnet position L2 is set to 5 mm from the end of the deflection coil and the magnet length LM is set to 31.5 mm. When the raster distortion is the pin distortion, the misconvergence takes the plus value and when the raster distortion is minus, the misconvergence become barrel-shaped. FIG. 12 merely shows that a case where the magnetization intensity is 11 gauss is used as the reference. It does not mean that the case where the magnetization intensity is 11 gauss is used is optimum. For example, when the screen distortion has a pin shape when the magnetization intensity is 11 gauss, by setting the magnetization intensity to 13 gauss, the raster distortion can be corrected by approximately 0.56 mm. However, the convergence is also changed. For example, SS is changed by 0.15 mm. Accordingly, it is difficult to sufficiently satisfy the improvement of the raster distortion and the improvement of the convergence by merely changing the magnetization intensity.

Figure 13:
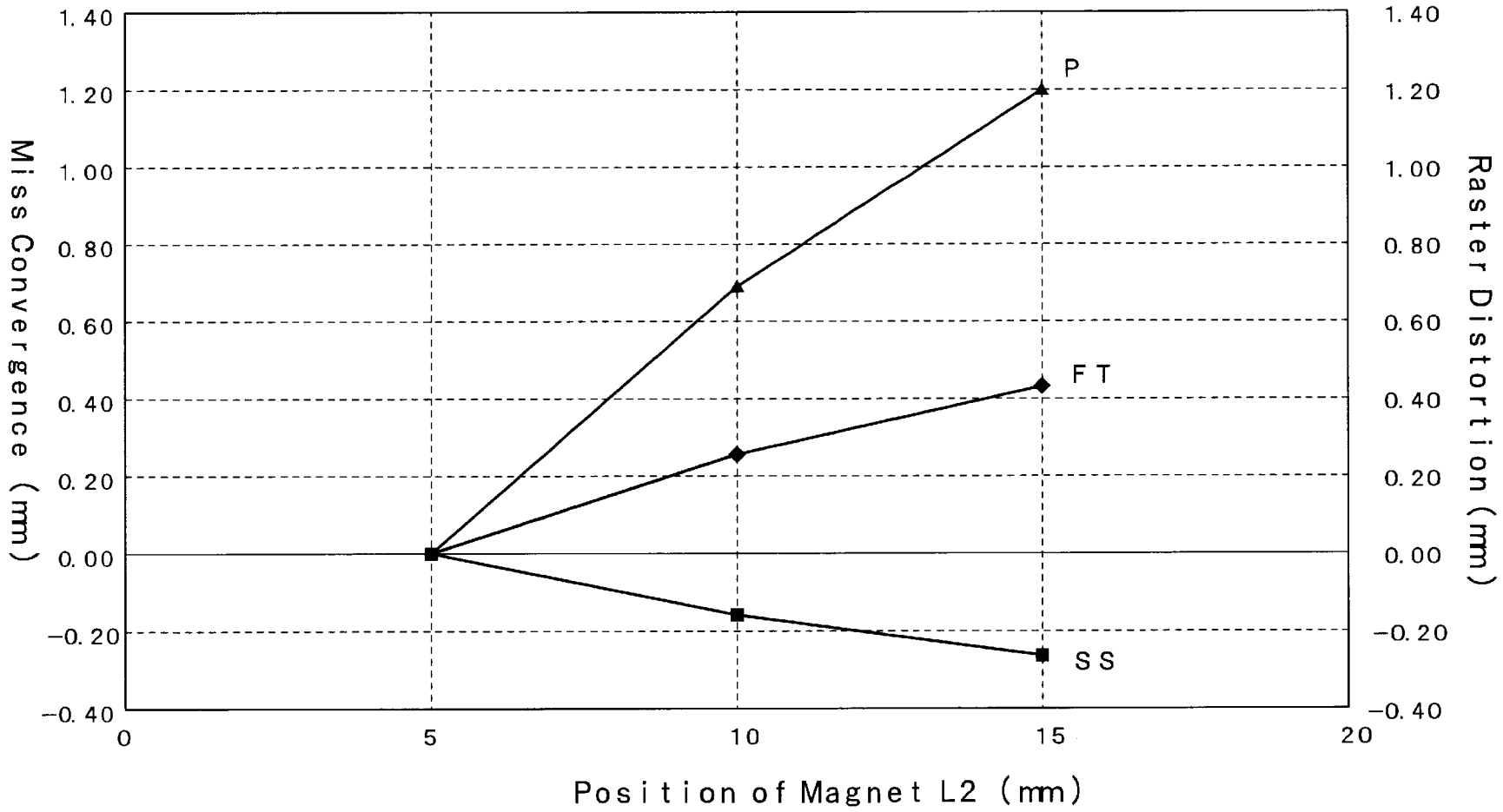
FIG. 13 is a diagram showing the change of the convergence and the raster distortion when the distance between a horizontal deflection coil and bar magnets is changed.
Figure 14:
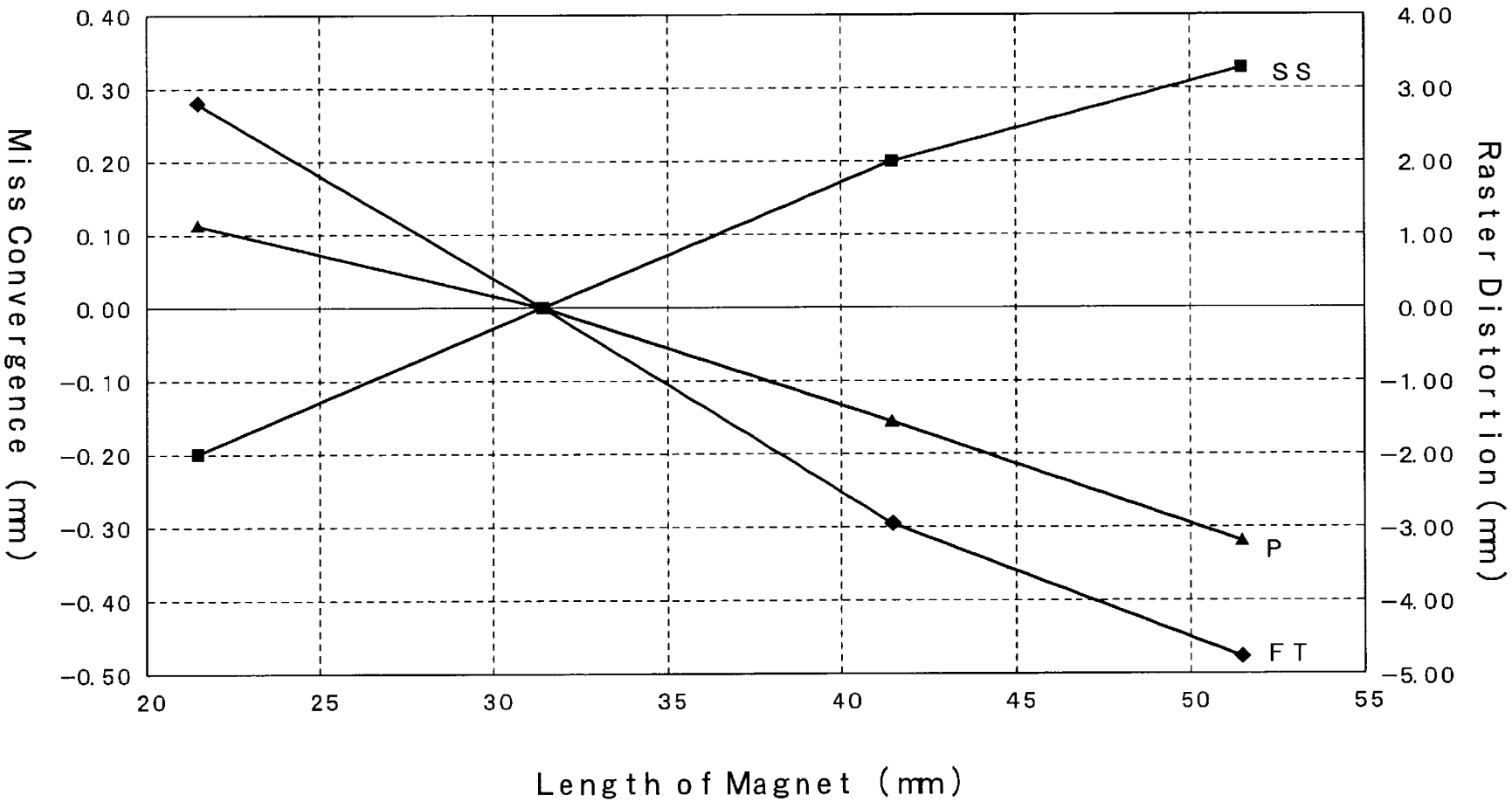
FIG. 14 is a diagram showing the change of the convergence and the raster distortion when the length of bar magnets is changed.

FIG. 13 shows the changes of the misconvergence and the raster distortion when the magnet position L2 is changed under the condition that the magnet length is fixed to 31.5 mm and the magnetization intensity is fixed to 11 gauss. FIG. 13 merely sets the reference convergence and the reference of the raster distortion to a case where the magnet position L2 is set to 5 mm. This, however, does not mean that L2=5 mm is optimum. FIG. 14 shows the changes of the misconvergence and the raster distortion when the magnet length ML is changed under the condition that the magnet position L2 is fixed to 5 mm and the magnetization intensity is fixed to 11 gauss. FIG. 14 merely adopts the case where the magnet length is 31.5 mm as the reference and this does not mean that the case where the magnet length is 31.5 mm is optimum. As shown in FIG. 14, by changing the magnet length, the raster distortion can be largely corrected while the convergence is changed. On the other hand, it is understood from FIG. 13 that by changing the magnet position L2, the convergence can be largely changed but the change of raster distortion is not apparent compared to that of FIG. 14. Further, the change of convergence takes the opposite direction between the case that the magnet position L2 is increased as shown in FIG. 13 and the case that the magnet length is changed as shown in FIG. 14. The above results suggest that there exists a condition which can substantially make the convergence reach zero while correcting the pin distortion by increasing the magnet position L2 and adjusting the magnet length.

Figure 15:
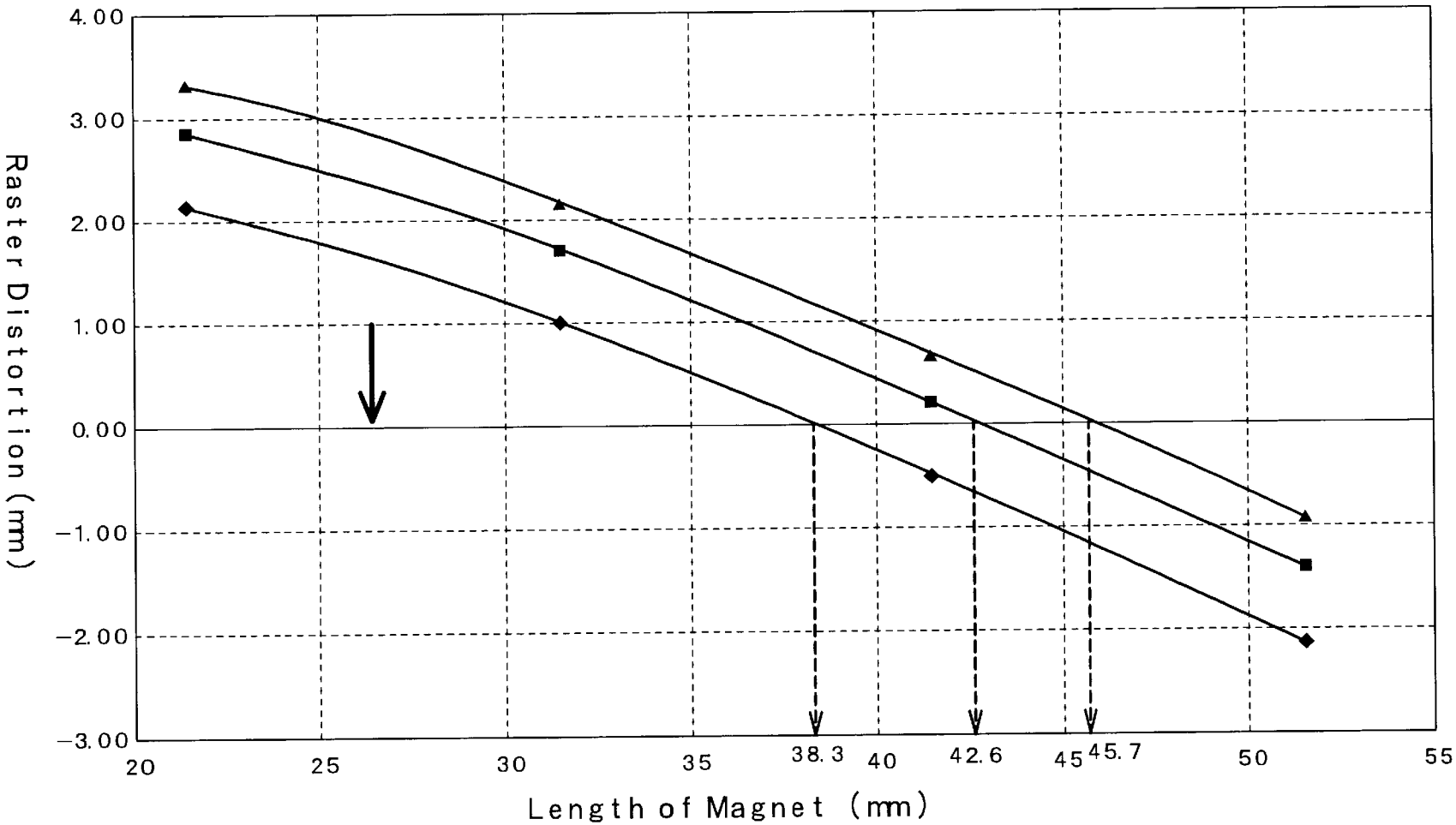
FIG. 15 is a diagram showing the change of the raster distortion when the length of bar magnets is changed while using the position of the bar magnets as a parameter.
Figure 16:
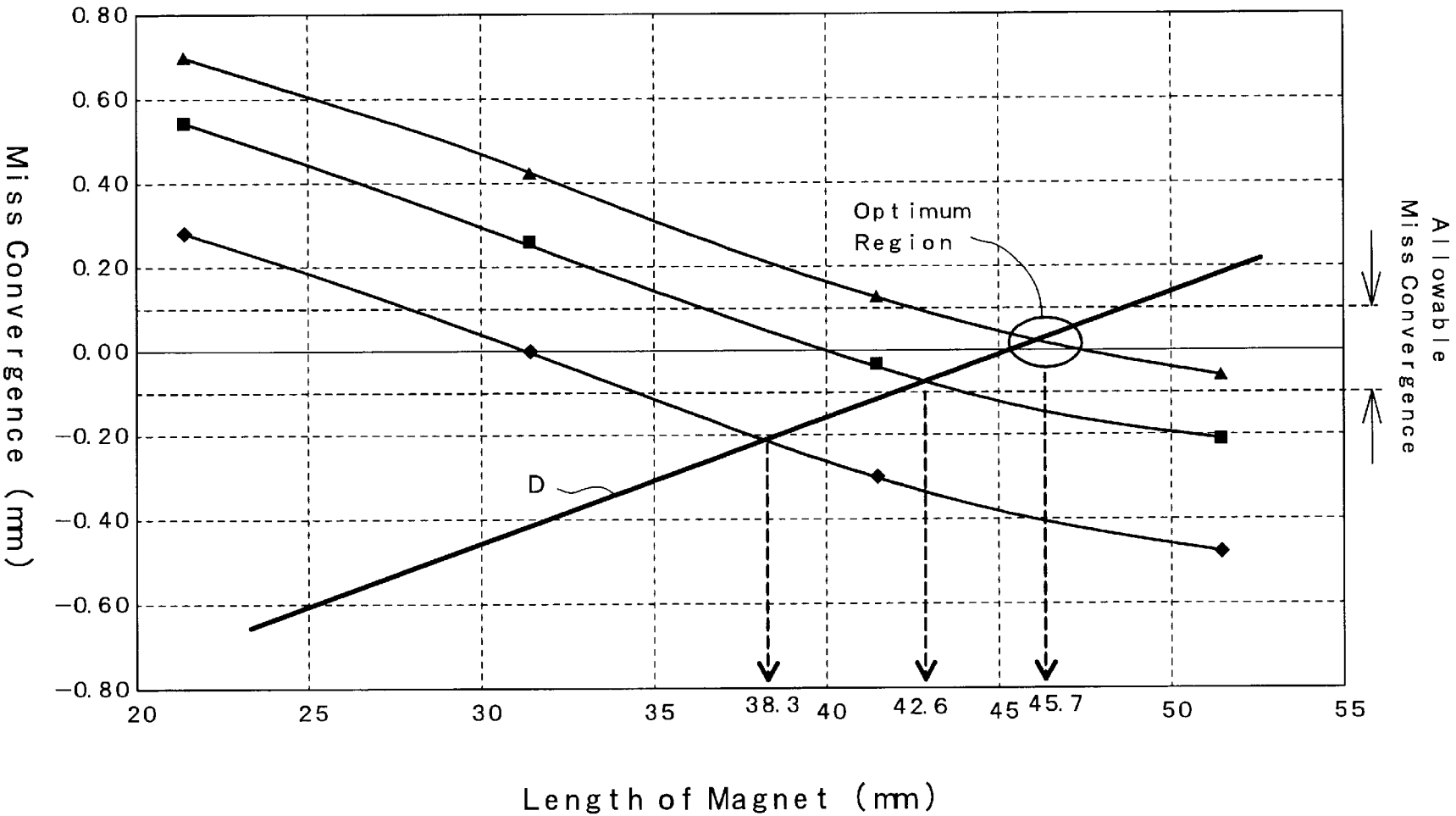
FIG. 16 is a diagram showing the change of the convergence when the length of bar magnets is changed while using the position of the bar magnets as a parameter.
Figure 17:
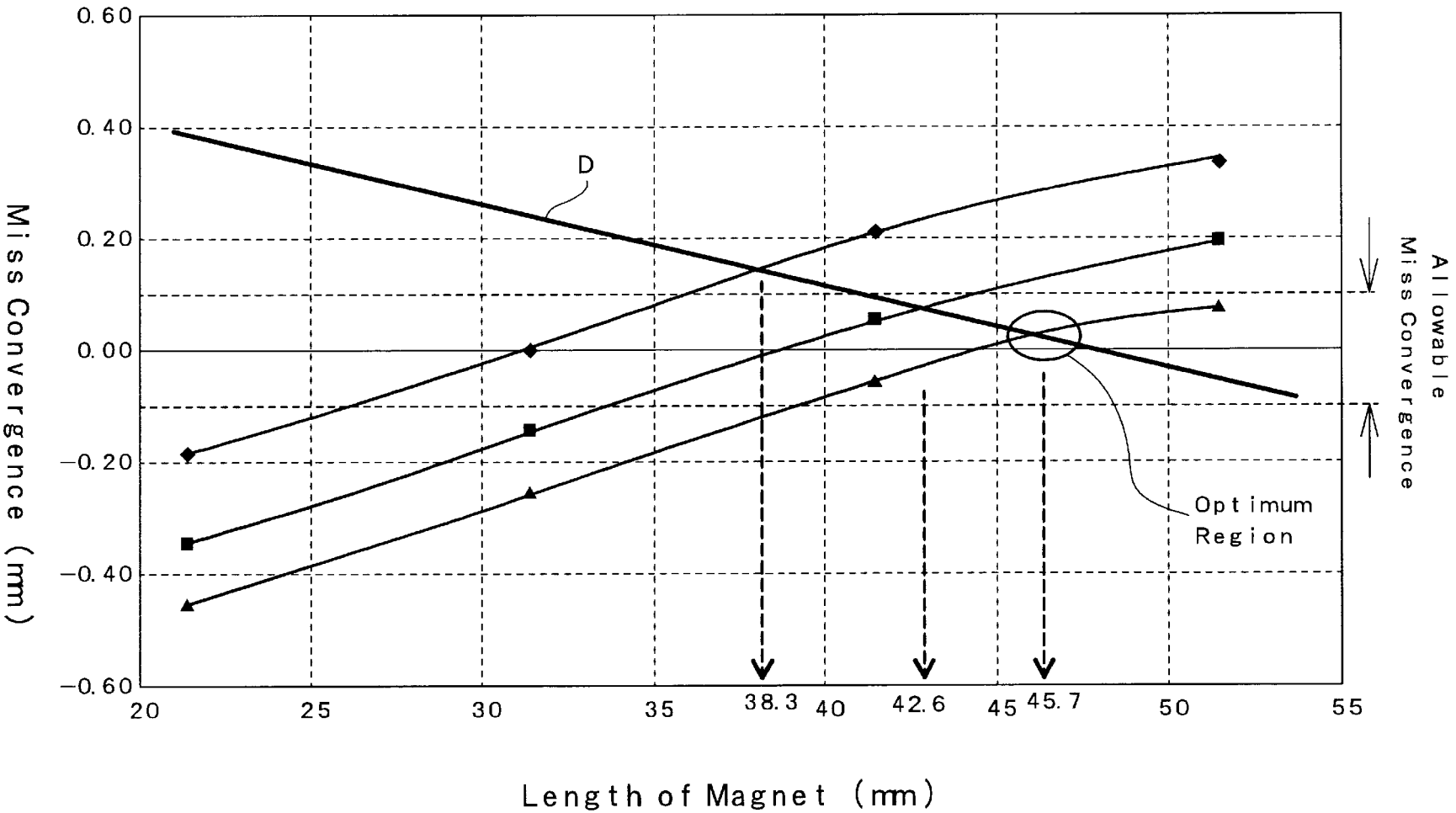
FIG. 17 is also a diagram showing the change of the convergence when the length of bar magnets is changed while using the position of the bar magnets as a parameter.
Figure 18:
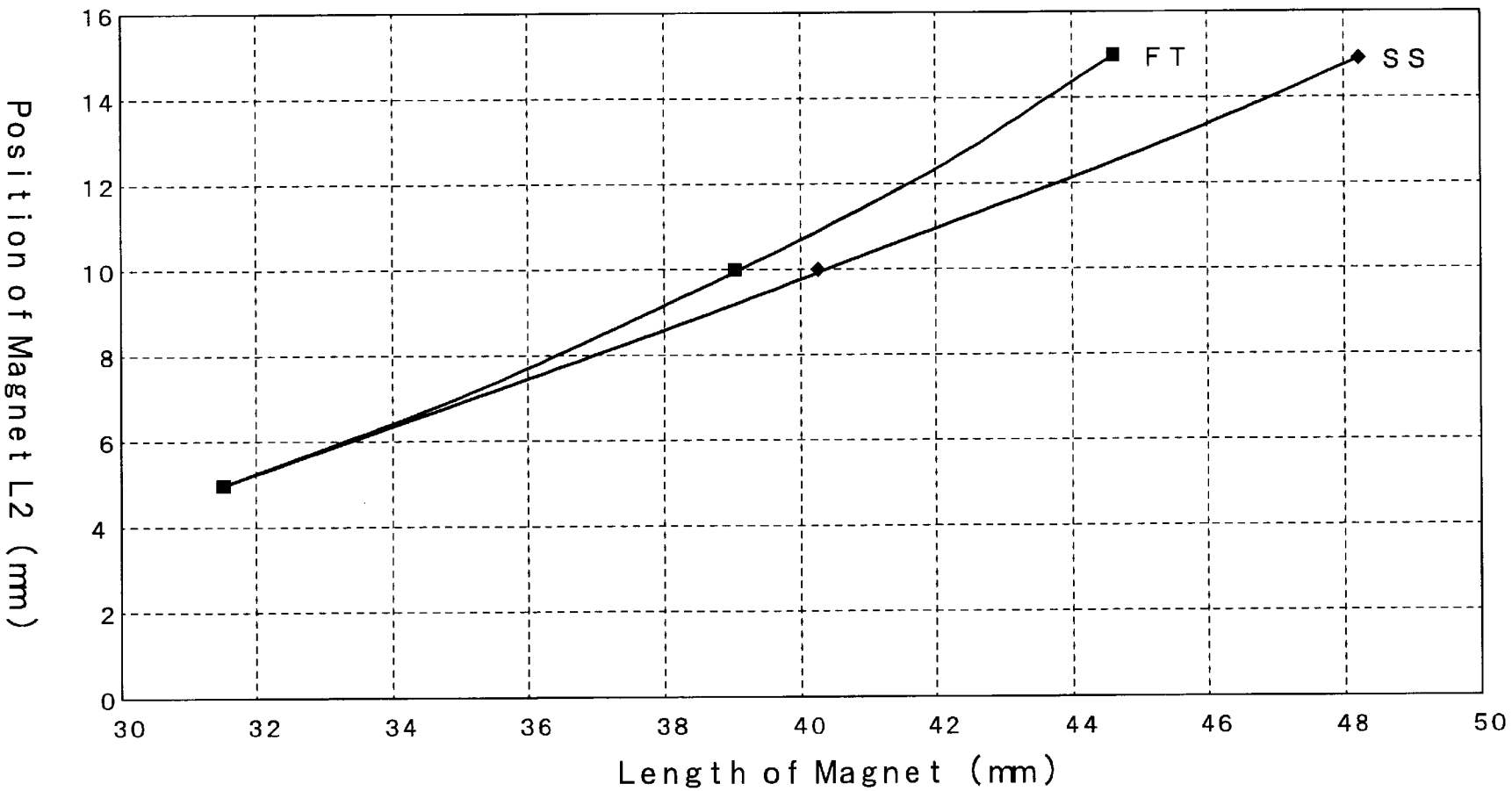
FIG. 18 is a diagram showing the relationship between the length of bar magnets and the position of the bar magnets for optimizing the convergence.

FIG. 15 shows the relationship between the magnet length and the raster distortion when the magnet position L2 is fixed to 5 mm, 10 mm and 15 mm respectively. For example, to correct the raster distortion by 1 mm, when the magnet position L2 is 5 mm, the magnet length may be changed from 31.5 mm to 38.3 mm. FIG. 16 shows the change of the convergence FT when the magnet position L2 is fixed to 5 mm, 10 mm and 15 mm respectively and the magnet length is changed. In case of the 2R panel, when the magnet position L2 is 5 mm, the magnet length is 31.5 mm and the magnetization intensity is 11 gauss, since the raster distortion and the convergence FT are both at the practically allowable level, the evaluation is made using the level of the convergence FT of this case as the reference. A curve D shown in FIG. 16 indicates a condition to correct the pin distortion of the screen by 1 mm. That is, FIG. 16 shows whether there exists a condition which can ignore the change of convergence or not when the magnet length is changed at respective distance L2 to correct the raster distortion. FIG. 16 shows that there exists the optimum value in the vicinity of L2=15 mm and even when L2=10 mm, the value which falls in the allowable level can be obtained. FIG. 17 shows the result obtained by carrying out the same evaluation as that of FIG. 16 on the convergence SS. As in the case of the convergence FT, there exists the optimum value in the vicinity of L2=15 mm and even when L2=approximately 10 mm, the value which falls in the allowable level can be obtained. As has been explained heretofore, when the exterior surface of the panel is made flat, the pin distortion of approximately 1 mm gives rise to a problem and hence, the above-mentioned evaluations have been made. However, if the pin distortion greater than 1 mm is to be corrected, the magnet position L2 and the magnet length ML are shifted to larger values. FIG. 18 shows the relationship between the magnet length ML and the magnet position L2 when the levels of the convergence FT, SS are held at substantially zero. Although the optimum condition slightly differs between the convergence FT and the convergence SS, the optimum condition may be decided by emphasizing one of these convergence or by taking the intermediate characteristics between the characteristics of both convergence. To correct the raster distortion of approximately 1 mm, the magnet position L2 must be not less than 10 mm.

Figure 19:
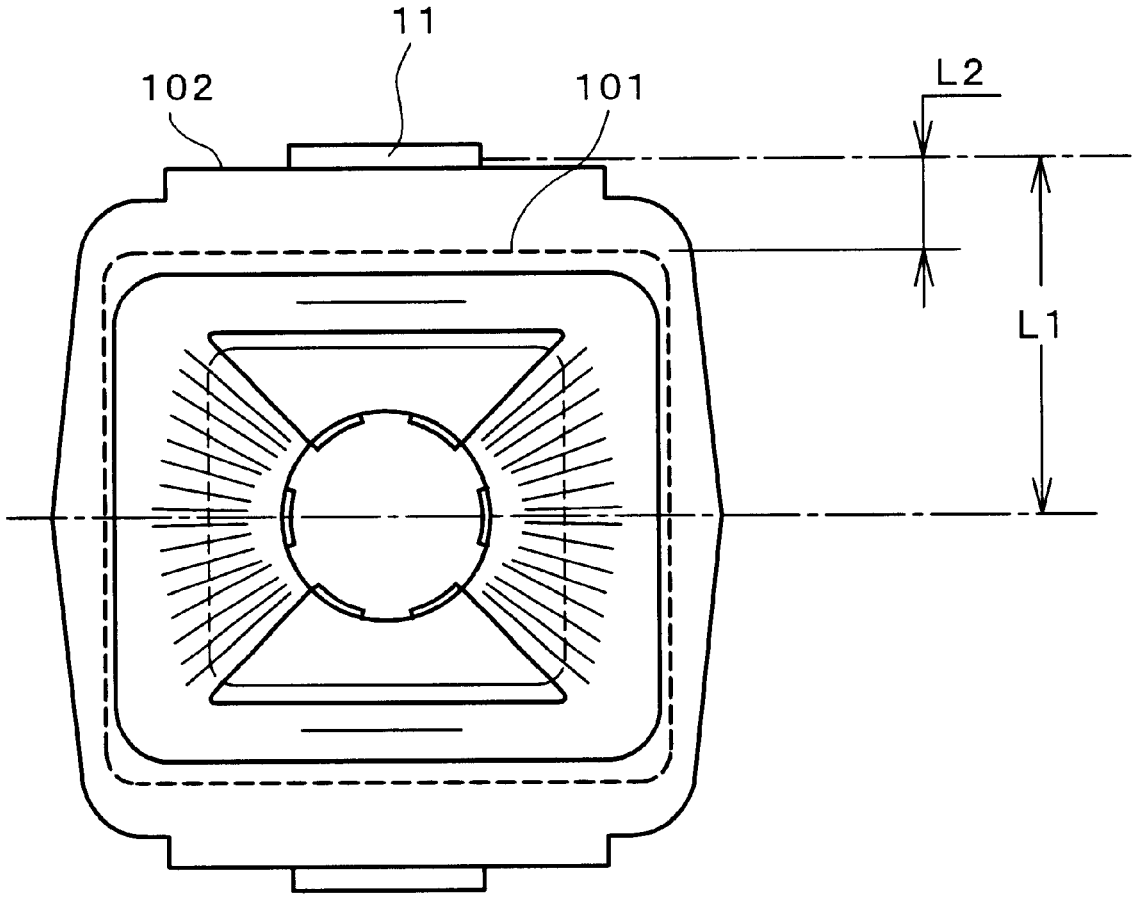
FIG. 19 is a front view of a rectangular type deflection yoke.
Figure 20:
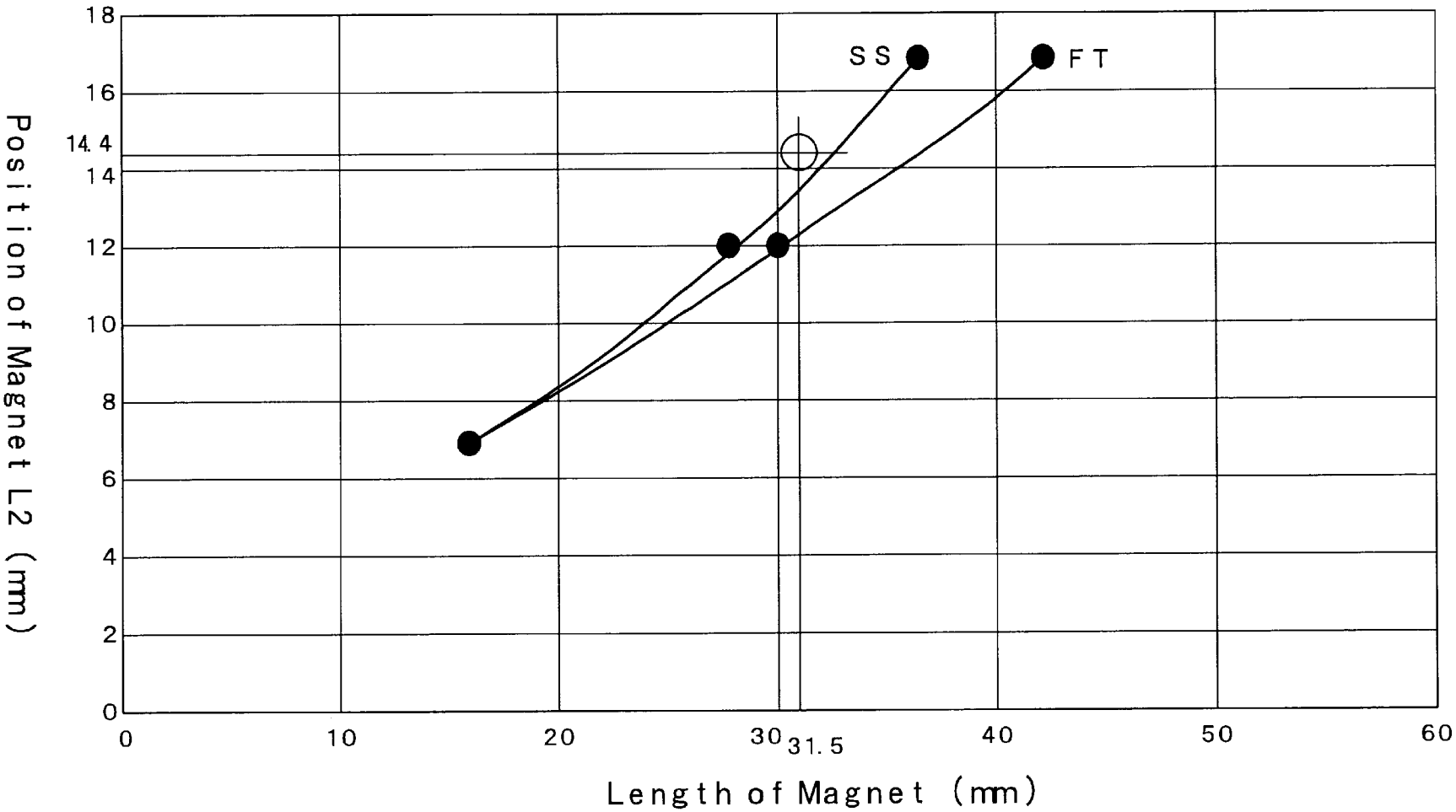
FIG. 20 is a diagram showing the relationship between the length of bar magnets and the position of the bar magnets for optimizing the convergence when the rectangular type deflection yoke is used.

Although the explanation has been made with respect to the round type deflection yoke used in the 17 inch cathode ray tube having the deflection angle of 100 degrees, the same technique is also applicable to other systems. FIG. 19 shows an example where the technique is applied to a cathode ray tube having a diagonal diameter of 21 inches, a flat panel exterior surface and a funnel 3 provided with a rectangular-type cone portion 33. In FIG. 19, parts identical with the parts shown in FIG. 4 are indicated by same numerals. The distance from the center of a deflection yoke to an upper end of a horizontal deflection coil is set to 43.9 mm (approximately 44 mm). The rectangular-type deflection yoke has an advantage that the deflection power can be reduced. Further, the rectangular-type deflection yoke has an advantage that the deflection yoke can be made compact. However, by making the exterior surface of a panel flat, the pin distortion also becomes a problem similarly with respect to this deflection yoke. Accordingly, to apply the present invention, it is necessary to increase the vertical dimension of a separator at an opening portion of the deflection yoke so as to shift magnets away from the horizontal coil of the deflection yoke. FIG. 20 shows the relationship between the magnet length ML and the magnet position L2 which can make the convergence become substantially zero in a case where a rectangular type deflection yoke is adopted by a color cathode ray tube having a flat panel and a diagonal diameter of 21 inches. In this case, when the magnet position L2 is set to approximately 15 mm, the both of the raster distortion and the convergence can be made substantially zero. When the magnet position L2 becomes approximately 10 mm, the misconvergence and the raster distortion fall within allowable levels. In this case, the distance L1 from the tube axis to the center of the bar magnet becomes approximately 54 mm. With respect to the rectangular type deflection yoke, since the yoke per se is smaller than that of the round type deflection yoke, the magnet length ML to make the convergence zero becomes small. In the color cathode ray tube having the diagonal diameter of 21 inches which constitutes this embodiment, the equivalent radius of curvature in the diagonal direction on the exterior surface of the panel is 57800 mm and the deflection angle is 90 degrees. In this case, the optimum magnet position L2 is 14.4 mm. Further, the distance L1 from the center of the cathode ray tube to the center of the magnet is 58.3 mm.

What is claimed is:

1. A color cathode ray tube comprising:

a panel portion having a phosphor screen m an interior surface thereof, a funnel portion, a neck portion storing an electron gun, a cone portion being formed on a portion connecting said funnel portion and said neck portion, a deflection yoke for deflecting electron beams being mounted on said cone portion, said deflection yoke including a core, a horizontal deflection coil, a vertical deflection coil and a separator, and bar magnets being mounted above and below said horizontal deflection coil of said deflection yoke such that said bar magnets are arranged approximately parallel to a panel surface and horizontally, wherein the distance between the cross-sectional direction center of said bar magnet and an upper end or a lower end of said horizontal deflection yoke is set to not less than 10 mm in the direction perpendicular to the tube axis of said cathode ray tube.

2. A color cathode ray tube according to claim 1, wherein said distance between the cross-sectional direction center of said bar magnet and the upper end or the lower end of said horizontal deflection yoke is set to not less than 15 mm.

3. A color cathode ray tube according to claim 1, wherein said distance between the cross-sectional direction center of said bar magnet and the upper end or the lower end of said horizontal deflection yoke is set to approximately 14.4 mm.

4. A color cathode ray tube according to claim 1, wherein said cone portion has a rectangular cross-sectional contour along the direction perpendicular to a tube axis and said horizontal deflection coil has a rectangular crosssectional contour along the direction perpendicular to a tube axis.

5. A color cathode ray tube according to claim 1, wherein the equivalent radius of curvature in the diagonal direction of an exterior surface of said panel is set to not less than 10,000 mm.

6. A color cathode ray tube according to claim 1, wherein the maximum deflection angle of said color cathode ray tube is set to 100 degrees.

7. A color cathode ray tube according to claim 1, wherein the length of said bar magnet is not less than 31.5 mm.

8. A color cathode ray tube comprising:

a panel portion having a phosphor screen in an interior surface thereof, a funnel portion, a neck portion storing an electron gun, a cone portion being formed on a portion connecting said funnel portion and said neck portion, a deflection yoke for deflecting electron beams being mounted on said cone portion, said deflection yoke including a core, a horizontal deflection coil, a vertical deflection coil and a separator, and bar magnets being mounted on said deflection yoke such that said bar magnets are arranged approximately parallel to a panel surface and horizontally, wherein said cone portion has an approximately rectangular cross-section along the direction perpendicular to a tube axis, a portion of said deflection yoke corresponding to said cone portion has a approximately rectangular cross-section along the direction perpendicular to said tube axis, and the distance between the cross-sectional direction center of said bar magnet and said tube axis is set to not less than 54 mm in the direction perpendicular to said tube axis.

9. A color cathode ray tube according to claim 8, wherein the distance between the cross-sectional direction center of said bar magnet and a tube axis is set to not less than 59 mm in the direction perpendicular to said tube axis.

10. A color cathode ray tube according to claim 8, wherein the length of said bar magnet is set to not less than 22 mm.

11. A color cathode ray tube according to claim 8, wherein the maximum deflection angle of said color cathode ray tube is set to 90 degrees.

12. A color cathode ray tube according to claim 8, wherein the equivalent radius of curvature in the diagonal direction of an exterior surface of said panel is set to not less than 10,000 mm.

13. A color cathode ray tube according to claim 8, wherein the length of said bar magnet is set to not less than 31.5 mm.

* * * * *